US005463412A

United States Patent [19]

Matsuda

[11] Patent Number: 5,463,412

[45] **Date of Patent: * Oct. 31, 1995**

[54] LIQUID JET RECORDING HEAD WITH MULTIPLE LIQUID CHAMBERS

[75] Inventor: Hiroto Matsuda, Ebina, Japan

[73] Assignee: Canon Kabushiki Kaisha, Tokyo, Japan

[ * ] Notice: The portion of the term of this patent subsequent to May 30, 2009, has been disclaimed.

[21] Appl. No.: 180,462

[22] Filed: Jan. 12, 1994

Related U.S. Application Data

[63] Continuation of Ser. No. 41,336, Apr. 1, 1993, abandoned, which is a continuation of Ser. No. 794,677, Nov. 18, 1991, abandoned, which is a continuation of Ser. No. 453,808, Dec. 20, 1989, abandoned, which is a continuation of Ser. No. 361,772, May 30, 1989, Pat. No. 4,914,736, which is a continuation of Ser. No. 82,917, Aug. 10, 1987, abandoned, which is a continuation of Ser. No. 747,564, Jun. 21, 1985, abandoned.

[30] Foreign Application Priority Data

Jul. 5, 1984 [JP] Japan ..... 59-139421

[51] Int. Cl.[6] ..... B41J 2/21

[52] U.S. Cl. ..... 347/43

[58] Field of Search ..... 347/43, 40, 63

[56] References Cited

U.S. PATENT DOCUMENTS

| | | | |
|---|---|---|---|
| 4,251,824 | 2/1981 | Hara | 347/57 |
| 4,330,787 | 5/1982 | Sato | 347/63 |
| 4,376,945 | 3/1983 | Hara et al. . | |
| 4,380,771 | 4/1983 | Takatori . | |
| 4,463,359 | 7/1984 | Ayata et al. . | |
| 4,479,134 | 10/1984 | Kawanabe . | |
| 4,490,728 | 12/1984 | Vaught . | |
| 4,500,895 | 2/1985 | Buck | 347/87 |
| 4,611,219 | 9/1986 | Sugitani | 347/40 |
| 4,675,696 | 6/1987 | Suzuki | 347/43 |
| 4,914,736 | 4/1990 | Matsuda | 347/43 |

FOREIGN PATENT DOCUMENTS

| | | | |
|---|---|---|---|
| 2944005 | 5/1980 | Germany . | |
| 3012552 | 10/1980 | Germany . | |
| 3012698 | 3/1981 | Germany . | |
| 3312372 | 10/1983 | Germany | B41J 3/04 |
| 2115748 | 9/1983 | United Kingdom . | |

*Primary Examiner*—Joseph W. Hartary

*Attorney, Agent, or Firm*—Fitzpatrick, Cella, Harper & Scinto

[57] ABSTRACT

A liquid jet recording head comprises plural discharge port groups and a corresponding plurality of liquid chambers for containing liquid to be discharged from the discharge ports. Each of the plural discharge ports has an opposing heat generating element, all of the heat generating elements being disposed on a single substrate having supply holes therein to supply liquid to the liquid chambers. The heat generating elements, being opposed to the discharge ports, are also disposed in groups, each having a common electrode and individual electrodes for the multiple heat generating elements in the group. The supply holes are located in the same area of the substrate as the individual electrodes, thus making the head compact.

14 Claims, 1 Drawing Sheet

LIQUID JET RECORDING HEAD WITH MULTIPLE LIQUID CHAMBERS

This application is a continuation of application Ser. No. 08/041,336 filed Apr. 1, 1993, now abandoned, which in turn is a continuation of application Ser. No. 07/794,677 filed Nov. 18, 1991, now abandoned, which in turn is a continuation of application Ser. No. 07/453,808 filed Dec. 20, 1989, now abandoned, which in turn is a continuation of application Ser. No. 07/361,772 filed May 30, 1989, now U.S. Pat. No. 4,914,736, issued Apr. 3, 1990, which in turn is a continuation of application Ser. No. 07/082,917 filed Aug. 10, 1987, now abandoned, which in turn is a continuation of application Ser. No. 06/747,564 filed Jun. 21, 1985, now abandoned.

BACKGROUND OF THE INVENTION

1. Field of the Invention

This invention relates to a liquid jet recording head by which liquid is jetted to form flying liquid droplets for recording.

2. Description of the Prior Art

Ink jet recording methods liquid jet recording methods) have recently drawn public attention because noise caused by recording is negligibly small, high speed recording is possible and recording can be effected on plain paper without any special treatment such as fixation.

Among them, liquid jet recording methods disclosed in Japanese Patent Application Laid-open No. 51837/1979, German Laid-open (DOLS) No. 2843064, U.S. Pat. No. 4,330,787 and U.S. Pat. No. 4,490,728 are different from other liquid jet recording methods in that thermal energy is applied to liquid to produce a driving power for discharging liquid droplets.

That is, according to the recording methods disclosed in the above-mentioned references, the liquid is subjected to heat energy which changes its state by abruptly increasing its volume. The resulting force due to the state change jets the liquid through an orifice at the tip of the recording head portion to form flying droplets which attach to a receiving member to effect recording.

In particular, the liquid jet recording method disclosed in the DOLS 2843064 can be very effectively applied in a so-called "drop-on demand" recording method and furthermore, can be easily used for recording heads of a full line type and a high density multi-orifice type. Thus, images of high resolution and high quality can be obtained at a high speed.

An on-demand type recording method refers to a recording method in which, upon forming recording images, droplets necessary for forming images are discharged in response to input signals. According to this method, there is no necessity of recovering and recirculating the ink. A continuous type recording method, where ink droplets are continuously discharged, (some ink droplets are used for recording and some are not, depending on the images to be recorded) needs such recovery and recirculation of ink. Therefore, the on-demand type recording apparatus is more suitable for miniaturizing and simplifying the apparatus than the continuous type method recording. The full line type refers to a method wherein orifices are arranged along the full recording width of a record receiving member (such as paper), and therefore, the full line type need not scan in the direction of paper width by the recording head. Thus, the full line type is suitable for increasing the recording speed as well as miniaturizing and simplifying the apparatus. In the full line type recording apparatus, for example, in the case of recording apparatus, for example, in the case of recording the full width of A-4 size paper (210 mm) with 8 orifices per 1 mm, 1680 orifices are continuously arranged resulting in a high density multi-orifice apparatus.

The recording head portions of an apparatus used in the above-mentioned recording method comprises a liquid discharging portion constituted of orifices and liquid flow paths communicating with the orifices and having heat actuating portions applying thermal energy for discharging liquid droplets to liquid, and electrothermal transducers for generating thermal energy.

Such a recording head may be constituted of a plurality of orifices arranged in line. Liquid flow paths communicating with respective orifices communicate with a common liquid chamber, and liquid may be fed to the liquid chamber from a liquid tank.

According to conventional color recording methods, that is, recording two or more colors, recording heads corresponding to each color are, in general, arranged depending upon the necessary number of colors, and ink is fed to the respective heads from an ink tank.

That is, in the case of recording two colors, e.g. red and black, there is used a recording head for red ink and a recording head for black ink. In the case of recording four or more colors, at least one recording head for each color, e.g. yellow, magenta, cyan and black, is usually used. Color recording according to such a method has an advantage in that it is sufficient to only arrange recording heads of the same structure corresponding to the number of the necessary colors. However, upon arranging two or more recording heads, high accuracy is required with respect to the relative positions of the recording heads. In order to meet such requisite, highly accurate processing is disadvantageously required for fabricating the recording heads and fixing devices for the recording heads.

The demand for recording color images of high resolution and high quality has been recently increasing to a great extent. The above-mentioned methods, where a plurality of recording heads are arranged, can not sufficiently satisfy the demand. High accuracy as to the position of recording dot on a receiving paper is required so that a particular processing of the recording head and fixing device should be contrived. As a result, the manufacturing cost becomes inevitably very high. Further, it is not easy to exchange the recording head since a severe adjustment of position is necessary.

In addition, when recording heads corresponding to the number of colors are so arranged, as the number of colors increases, the total volume of the recording head becomes so large that the recording head is difficult to apply to a small and compact printer. In addition, the total weight of the head increases. As a result, the running system of a carriage carrying such a head for recording is disadvantageously heavily loaded.

SUMMARY OF THE INVENTION

An object of the present invention is to provide a recording head free from the above-mentioned drawbacks.

Another object of the present invention is to provide a recording head capable of easily effecting color and graduation recordings of high quality and high resolution and further of low cost and small and compact size.

It is further object of the present invention to provide a liquid jet recording apparatus comprising liquid chambers communicating with a plurality of discharge orifices for discharging a recording liquid to form flying liquid droplets for accommodating said recording liquid and heat generating elements for generating energy used for forming said flying liquid droplet characterized in that a plurality of heat generating element groups, each of which includes a plurality of said heat generating elements on the same integral substrate member are respectively and independently provided and a liquid chamber is independently provided in each of said element groups.

DETAILED DESCRIPTION OF THE PREFERRED EMBODIMENT

Figure 1:
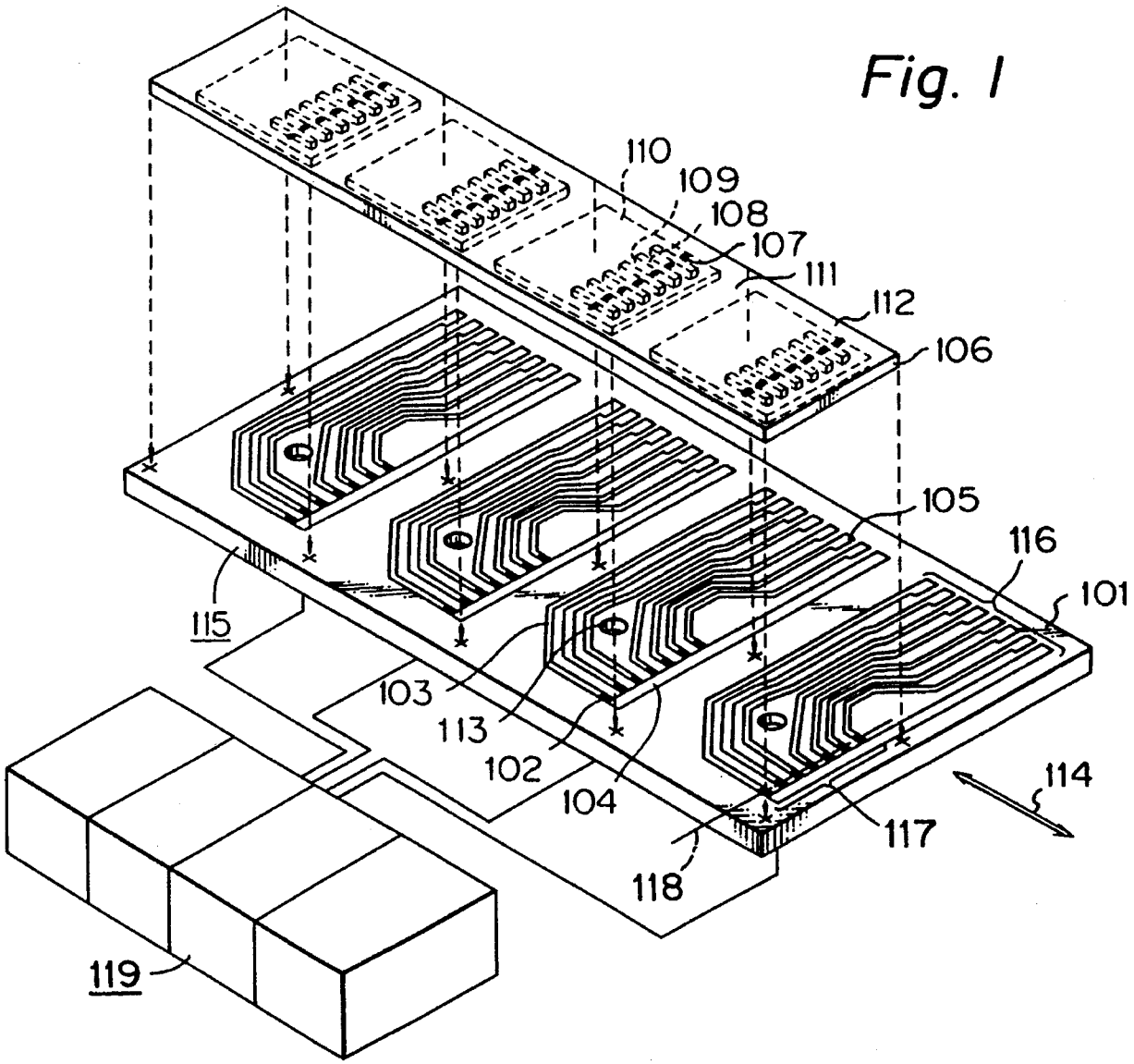
FIG. 1 is an exploded oblique view of an embodiment of a recording head of the present invention.

Now the present invention will be explained in greater detail.

The foregoing objects can be achieved, according to the present invention, by an integral recording head comprising;

a liquid discharge portion, including plural recording-liquid discharge orifices for forming flying liquid droplets by discharging recording liquids, and thermal acting portions, communicating with the orifices, such that the thermal energy acts on the liquid; and an electro-thermal conversion member, in which heat generating portions thereof are formed between at least one pair of electrodes electrically connected to a heat generating resistive layer formed on a supporting member, wherein plural thermal acting portions and respectively corresponding orifices are formed on a single integral substrate member in plural groups, each of which is associated with a common liquid chamber communicating with the orifices of said group, and wherein the liquid chambers of these groups are mutually separated so as to avoid liquid mixing between different groups, thereby enabling separate discharge of two or more liquids.

The present invention provides an extremely compact recording head capable of multi-color and variable density recordings of a high image quality and a high resolution power at a low cost and in an easy manner. Plural heat generating element groups and respectively corresponding groups of orifices are formed on a integral substrate member and inks are introduced to the groups of orifices from different inlets without mixing of inks. In the conventional method of using two or more recording heads for multi-color recording, each head and mounting element requires particular designing with precise dimensions for mutual alignment of the orifices so that a high resolution power is achieved at the sacrifice of a very high cost and is still associated with a certain limitation. On the other hand, the present invention can easily provide, at a very low cost, a recording head capable of fine image recording, because the groups of heat generating elements and of orifices are formed in one step respectively on an integral substrate member and an integral liquid chamber member, thus ensuring a very high positional precision and a high orifice density. Also, the recording head of the present invention is very small and light as the orifice groups corresponding to different colors are formed on a single substrate. This allows miniaturization of a printer utilizing such a recording head and a reduced load for a carriage driving system for moving the recording head with respect to a recording paper.

In addition, the heads for different colors can be obtained with uniform characteristics, ensuring high-quality recording, because plural head units, each containing heat generating elements and orifices, can be prepared with substantially the same shape and condition.

The inks to be supplied to the head units formed on a same substrate may be those of a color combination for full-color reproduction, a so-called multi-color recording, or can be those of similar colors with different densities for a richer tonal rendition.

EMBODIMENT OF THE PRESENT INVENTION

Now the present invention will be clarified in detail by an embodiment thereof.

FIG. 1 is an exploded view of a recording head 115 constituting a representative embodiment of the present invention. On an integral substrate member 101, composed for example of glass, ceramic glazed ceramic or silicon, there are formed heat-generating resistors 102, individual electrodes 103, common electrodes 104 and electrode pads 105. These resistors and electrodes are usually formed by thin film formation through vacuum evaporation or sputtering, followed by etching of unnecessary parts through known photolithographic process. The electrode pads 105 are provided for connection with unrepresented external wires for example by wire bonding. Supplying holes 113 penetrate the integral substrate member 101, and inks introduced from a tank 119 comprised of unrepresented ink reservoirs are guided through said supplying holes 113, from the lower face of the integral substrate member 101 to the upper face thereof bearing the heat-generating resistors 102 etc. As shown in FIG. 1, the heat generating resistors 102 are divided into plural heat generating element groups 117 arranged along a line 118 in each of which said resistors are connected to a common electrode 104, and each of which is provided with a supplying hole 113. In FIG. 1, four substantially identical and identically oriented electrode patterns 116 each containing 7 heat generating resistors are formed on the integral substrate member 101. On the integral substrate member 101 there is bonded an integral liquid chamber member 106 in a position indicated by broken-lined arrows. The integral liquid chamber member 106 is composed for example of glass, ceramic, silicon, a metal such as stainless steel or nickel, or an organic synthetic resin. The integral liquid chamber member 106 is provided with four groups of orifices 107 for discharging inks, each group being precisely located with respect to the others, barriers 108 for effectively applying a pressure generated in the heat generating unit toward the orifice and avoiding the interference of pressure energy generated for liquid emission in a heat generating unit with neighboring heat generating units. Between the barriers 108 there are formed liquid paths for guiding ink to the orifices. These orifices 107, barriers 108 and liquid paths 109 are formed, respectively corresponding to the heat-generating elements, in plural groups on the integral liquid chamber member 106, and the barriers 108 are so positioned that they are positioned in the spaces between the consecutive heat-generating resistive layer when the integral liquid chamber member 106 is bonded according to the broken-lined arrows. A liquid chamber 110 is formed communicating with the liquid paths 109 belonging to each group. When the integral liquid chamber member 106 is bonded to the integral substrate member 101, the supplying hole 113 is positioned in the bottom of each liquid chamber 110, into which the ink is introduced through said supplying hole 113. In FIG. 1, four liquid chambers 110 are formed as recesses on the lower face of the integral liquid chamber member 106 and are mutually separated by partitions 111. Consequently the ink introduced through a supplying hole 113 enters a corresponding liquid chamber 110 and is guided to the liquid path 109 and orifices 107 of a group but does not mix with the inks introduced through other supplying holes 113. The integral substrate member 101 integral liquid chamber member 106 can be bonded in various manners, but an easy and secure bonding can be achieved for example with an epoxy adhesive. The adhesive is so coated that the bonding takes place at least in the lower face of the partitions 111 and lateral walls 112.

As explained in the foregoing, the liquid-emission recording head of the present invention shown in FIG. 1 is provided with a common integral substrate member 101, equipped with four groups of orifices 107, four ink introducing supplying holes 113 and electrode pads 105 divided into four groups.

By introducing different color inks of yellow, magenta, cyan and black to the respective liquid chambers of the above-described recording head and providing image signals of corresponding colors to the electrode pads 105 of corresponding groups, the liquids of four colors are emitted from the orifices 107 in response to said image signals, so that four substantially identical, separate color recording can be achieved by moving said recording head in a direction indicated by an arrow 114.

The foregoing embodiment provides a recording head capable of satisfactory image recording because the effective density of the orifices of each color is not lowered even in a full-color construction and the positional precision of orifices is extremely high.

Although the present invention has been explained by the foregoing embodiment of a multi-color recording head having four groups of orifices 107 on a same face of the substrate as shown in FIG. 1, the present invention is likewise applicable to any recording head having at least two groups of orifices 107 and two or more corresponding liquid chambers 110 and supplying holes 113.

Also a further simplified recording head is obtained by positioning the tank 119 comprised of unrepresented ink reservoirs, communicating with the liquid chambers 110 through supplying holes 113, on a face of the integral substrate member 101 opposite to the face thereof bearing the heat-generating resistors.

The foregoing embodiment is provided with the barriers 108 between the orifices, but the barriers, can be dispensed with if the interference of liquid emitting pressure of the neighboring heat generating element is tolerable.

As stated above, the heat generating element used in the embodiment according to the present invention has a heat generating resistive layer and at least one pair of electrodes electrically connected to the heat generating resistive layer. And, although in the foregoing explanation one of the electrodes is used as a common electrode in each of the groups, each of the electrodes may be independently provided, or one of the electrodes may be used as a common electrode in plural groups unless the one electrode is used as a common electrode in each of the groups. It is apparent that the above case can be covered with the gist of the present invention that a plurality of the heat generating element groups are independently provided.

Further, the recording liquid to be supplied is not limited to be different in color, and even if the colors of the recording liquids are substantially equal to each other, the recording liquids to be supplied may differ from each other in density. In such case, it is possible to obtain an image recorded with an extremely improved graduation reproductivity.

We claim:

1. A liquid jet recording head for recording by moving in a predetermined direction with respect to a recording medium and discharging recording liquid, the head comprising:

an integral substrate member including a single substrate, a plurality of at least three electrode patterns, each said pattern having a plurality of electrodes and a like plurality of heat generating element groups formed side-by-side directly on one side of said single substrate, each said group of heat generating elements being substantially identical and substantially identically oriented, including having the same number of plural heat generating elements for generating thermal energy; and an integral liquid chamber member having a plurality of recesses attached to said integral substrate member to form on said substrate a like plurality of substantially identical separate liquid chambers prevented from fluid communication with each other for accommodating recording liquids having different colors or densities, each said separate liquid chamber being associated with one of said heat generating element groups and including a plurality of liquid paths and a plurality of like discharge port groups each having a plurality of discharge ports, each liquid path being associated with one of said discharge ports adjacent one of said heat generating elements in said associated group, so that recording liquid supplied to said liquid chamber can be supplied to said heat generating elements in said associated group for selective discharge from said discharge ports by the thermal energy generated by said heat generating elements, and each said discharge port group being associated with a corresponding said heat generating element group and including the same number of discharge ports identically arranged in all of said discharge port groups with the corresponding discharge ports in different said discharge port groups being equally spaced relative to each other in the predetermined direction.

2. A liquid jet recording head according to claim 1, wherein all of said electrode patterns are substantially identical and substantially identically oriented side-by-side on said substrate.

3. A liquid jet recording head according to claim 1, wherein said liquid chamber member further includes a barrier at each space between said discharge ports.

4. A liquid jet recording head according to claim 1, wherein each said heat generating element includes a heat generating layer electrically connected to an electrode associated therewith.

5. A liquid jet recording head according to claim 4, wherein each group of said heat generating elements includes a common electrode.

6. A liquid jet recording head according to claim 5, wherein said common electrode is common to said groups of said heat generating elements.

7. A liquid jet recording head according to claim 1, wherein said plural heat generating elements in each said group are arranged along a line.

8. A liquid jet recording head according to claim 1, wherein each said supplying hole is provided through said integral substrate member.

9. A liquid jet recording apparatus comprising:

a liquid jet recording head for recording by moving in a predetermined direction with respect to a recording medium and discharging recording liquid, said head comprising:

an integral substrate member including a single substrate, a plurality of at least three electrode patterns, each said pattern having a plurality of electrodes and a like plurality of heat generating element groups formed side-by-side directly on one side of said single substrate, each said group of heat generating elements being substantially identical and substantially identically oriented, including having the same number of plural heat generating elements for generating thermal energy; and an integral liquid chamber member having a plurality of recesses attached to said integral substrate member to form on said substrate a like plurality of substantially identical separate liquid chambers prevented from fluid communication with each other for accommodating recording liquids having different colors or densities, each said separate liquid chamber being associated with one of said heat generating element groups and including a plurality of liquid paths and a plurality of like discharge port groups each having a plurality of discharge ports, each liquid path being associated with one of said discharge ports adjacent one of said heat generating elements in said associated group, so that recording liquid supplied to said liquid chamber can be supplied to said heat generating elements in said associated group for selective discharge from said discharge ports by the thermal energy generated by said heat generating elements, and each said discharge port group being associated with a corresponding said heat generating element group and including the same number of discharge ports identically arranged in all of said discharge port groups with the corresponding discharge ports in different said discharge port groups being equally spaced relative to each other in the predetermined direction; and driving means for moving said head along the predetermined direction.

10. A liquid jet recording apparatus according to claim 9, wherein all of said electrode patterns are substantially identical and substantially identically oriented side-by-side on said substrate.

11. A liquid jet recording apparatus according to claim 9, further comprising a tank communicating with each of said supplying holes.

12. A liquid jet recording apparatus according to claim 9, wherein said plural heat generating elements in each said group are arranged along a line.

13. A liquid jet recording apparatus according to claim 9, wherein each supplying hole is provided through said integral substrate member.

14. A liquid jet recording head for recording by moving in a predetermined direction with respect to a recording medium and discharging recording liquid, the head comprising:

an integral substrate member including a single substrate, a plurality of at least three electrode patterns, each said pattern having a plurality of electrodes and a like plurality of heat generating element groups formed side-by-side directly on one side of said single substrate, each said group of heat generating elements being substantially identical and substantially identically oriented, including having the same number of plural heat generating elements for generating thermal energy; and an integral liquid chamber member attached to said integral substrate member, whereby a like plurality of substantially identical separate liquid chambers prevented from fluid communication with each other for accommodating recording liquids having different colors or densities are provided, each said separate liquid chamber being associated with one of said heat generating element groups and including a plurality of liquid paths and a plurality of like discharge port groups each having a plurality of discharge ports, each liquid path being associated with one of said discharge ports adjacent one of said heat generating elements in said associated group, so that recording liquid supplied to said liquid chamber can be supplied to said heat generating elements in said associated group for selective discharge from said discharge ports by the thermal energy generated by said heat generating elements, and each said discharge port group being associated with a corresponding said heat generating element group and including the same number of discharge ports identically arranged in all of said discharge port groups with the corresponding discharge ports in different said discharge ports groups being equally spaced relative to each other in the predetermined direction.

* * * * *

UNITED STATES PATENT AND TRADEMARK OFFICE

CERTIFICATE OF CORRECTION

PATENT NO. : 5,463,412

DATED : October 31, 1995

INVENTOR(S) : HIROTO MATSUDA

It is certified that error appears in the above-indentified patent and that said Letters Patent is hereby corrected as shown below:

COLUMN 1

Line 24, "methods liquid" should read --methods (liquid--.

COLUMN 2

Line 3, "recording apparatus, for example, in the case" should be deleted.
Line 67, "further" should read --a further--.

COLUMN 3

Line 6, "droplet" should read --droplets--.
Line 23, "comprising;" should read --comprising:--.
Line 48, "a" should read --an--.

COLUMN 5

Line 8, "101 integral" should read --101 and integral--.
Line 25, "recording" should read --recordings--.
Line 48, "barriers," should read --barriers--.

UNITED STATES PATENT AND TRADEMARK OFFICE

CERTIFICATE OF CORRECTION

PATENT NO. : 5,463,412

DATED : October 31, 1995

INVENTOR(S) : HIROTO MATSUDA

It is certified that error appears in the above-indentified patent and that said Letters Patent is hereby corrected as shown below:

COLUMN 6

Line 66, "wherein each said" should read --wherein a--.

COLUMN 8

Line 1, "each of said" should be deleted.
Line 7, "wherein each" should read --wherein a--.

Signed and Sealed this

Thirtieth Day of April, 1996

Bruce Lehman

*Attest:*

BRUCE LEHMAN

*Attesting Officer*

*Commissioner of Patents and Trademarks*